US005141664A

United States Patent [19]

Corring et al.

[11] Patent Number: 5,141,664

[45] Date of Patent: * Aug. 25, 1992

[54] CLEAR DETERGENT GEL COMPOSITIONS HAVING OPAQUE PARTICLES DISPERSED THEREIN

[75] Inventors: Robert Corring, Rockaway Township, Morris County; Robert Gabriel, Maplewood, both of N.J.

[73] Assignee: Lever Brothers Company, a Division of Conopco, Inc., New York, N.Y.

[ * ] Notice: The portion of the term of this patent subsequent to Jun. 6, 2006 has been disclaimed.

[21] Appl. No.: 439,492

[22] Filed: Dec. 30, 1987

[51] Int. Cl.[5] ..... C11D 17/00; C11D 7/54; C11D 7/10

[52] U.S. Cl. ..... 252/90; 252/91; 252/95; 252/102; 252/140; 252/173; 252/174.12; 252/174.13; 252/174.24; 252/174.25

[58] Field of Search ..... 252/90, 91, 95, 102, 252/140, 173, 174.12, 174.13, 174.24, 174.25

[56] References Cited

U.S. PATENT DOCUMENTS

| | | | |
|---|---|---|---|
| 3,011,950 | 12/1961 | Mehaffey | 252/539 |
| 3,015,128 | 1/1962 | Somerville | 18/2.6 |
| 3,310,612 | 3/1967 | Somerville | 264/4 |
| 3,389,194 | 6/1968 | Somerville | 264/4 |
| 3,609,102 | 9/1971 | Schlossman | 252/522 |
| 3,898,186 | 8/1975 | Mermelstein et al. | 252/528 |
| 3,919,409 | 11/1975 | Perla | 424/52 |
| 4,078,099 | 3/1978 | Mazzola | 427/213 |
| 4,090,973 | 5/1978 | Maguire | 252/174.12 |
| 4,115,315 | 9/1978 | Marinelli | 252/316 |
| 4,116,849 | 9/1978 | Leikhim | 252/103 |
| 4,126,674 | 11/1978 | Mausner | 424/31 |
| 4,145,184 | 3/1979 | Brain | 8/137 |
| 4,226,736 | 10/1980 | Bush et al. | 252/135 |
| 4,260,528 | 4/1981 | Fox et al. | 252/525 |
| 4,376,762 | 3/1983 | Hauschild | 424/49 |
| 4,431,559 | 2/1984 | Ulrich | 252/99 |
| 4,536,183 | 8/1985 | Namnath | 8/107 |
| 4,597,886 | 7/1986 | Goedhart et al. | 252/95 |
| 4,601,845 | 7/1986 | Namnath | 252/99 |
| 4,626,373 | 12/1986 | Finch et al. | 252/96 |
| 4,648,987 | 3/1987 | Smith | 252/559 |
| 4,655,780 | 4/1987 | Chun et al. | 8/108.1 |
| 4,657,784 | 4/1987 | Olson | 427/213 |

FOREIGN PATENT DOCUMENTS

| | | | |
|---|---|---|---|
| 2360107 | 6/1975 | Fed. Rep. of Germany | 252/174.13 |
| 2721278 | 11/1977 | Fed. Rep. of Germany | 252/546 |
| 83/03621 | 10/1983 | PCT Int'l Appl. | |
| 2116199 | 9/1983 | United Kingdom | |
| 2140450 | 11/1984 | United Kingdom | |

OTHER PUBLICATIONS

"Chemical Technology", Oct. 1974, pp. 623–626 by Goodwin and Somerville entitled Microencapsulation by Physical Methods.

J. Ferry, "Viscoelastic Properties of Polymers", Third Edition, John Wiley & Sons, New York 1980.

"B. F. Goodrich Technical Bulletin on Carbopol".

*Primary Examiner*—Paul Lieberman
*Assistant Examiner*—William S. Parks
*Attorney, Agent, or Firm*—Milton L. Honig

[57] ABSTRACT

A cleaning composition is provided comprising a clear gel with opaque particles of an active material uniformly dispersed and suspended within the gel. A surfactant is present in the gel. The active material is surrounded by a protective substance such as an encapsulating layer. Representative of active materials are chlorine and oxygen bleaches, bleach precursors, enzymes, fabric softeners, surfactants, perfumes and mixtures of these materials.

4 Claims, No Drawings

CLEAR DETERGENT GEL COMPOSITIONS HAVING OPAQUE PARTICLES DISPERSED THEREIN

BACKGROUND OF THE INVENTION

1 Field of the Invention

The invention relates to a clear detergent composition in gel form having opaque particles of active material uniformly dispersed therein, the compositions being useful for the cleaning of hard surfaces.

2. The Prior Art

Household detergent products traditionally have taken the form of a powder or a relatively low viscosity liquid. Powders have several disadvantages. They are dusty, difficult to accurately dose, susceptible to lump formation or "caking" during storage, and require more expensive manufacturing equipment than liquids. On the other hand, low viscosity liquids need to have all ingredients mutually miscible or otherwise must suspend the immiscible components. For those components that are mutually miscible, there frequently arises a chemical incompatibility. For instance, there may be incompatibility between anionic and cationic type compounds. Another example of incompatibility occurs between a reactive hypochlorite bleach and oxidation sensitive perfumes or surfactants.

Recently, there has been a trend to utilize thixotropic liquids which have the benefits of pourability and immobility characteristic of solids. Thixotropic liquid products can more easily suspend immiscible components and do provide some separation between aggressive and sensitive components.

One product category in which the thixotropic liquid form has found consumer acceptance is that of automatic dishwashing compositions. Subsequent discussion will focus upon such compositions. However, automatic dishwashing products are merely representative of numerous other product categories toward which the present invention is directed.

A large body of patent literature has emerged in the autodish area of detergent chemistry which provides relevant background to the present invention. Typical of automatic dishwashing technology are those thixotropic liquid compositions disclosed in U.S. Pat. No. 4,116,849 (Leikhim), U.S. Pat. No. 4,431,559 (Ulrich), GB U.S. Pat. No. 2 116 199A (Julemont et al.) and GB U.S. Pat. No. 2 140 450A (Julemont et al.). A characteristic of the foregoing art is use of clay materials as thickeners to suspend electrolytes of limited water solubility. Clays normally scatter light imparting a dull and opaque appearance to the thixotropic liquids. Thereby results compositions of aesthetically undistinguished appearance. A product of a more pleasing transparent character is not therewith attainable.

Liquids, unlike powders, have a serious problem with component compatibility. For instance, chlorine releasing bleaches, normally found in powdered formulations, oxidatively attack many co-components found in liquid automatic dishwashing detergent compositions. Oxidation sensitive components include perfumes, surfactants and dyes.

Fabric washing formulations have been reported which encapsulate the bleach to isolate the latter from oxidation sensitive co-components. Illustrative is U.S. Pat. No. 4,655,780 (Chun et al.). Encapsulates usually comprise one or more outer protective coatings surrounding a core of a solid chlorine releasing material.

The core material may be a potassium or sodium hydrated dichloroisocyanurate. Coatings may be formed from fatty acids, soaps, waxes, and organic polymers or copolymers. Examples of encapsulated materials and processes for their preparation may be found in U.S. Pat. No. 4,078,099 (Mazzola), U.S. Pat. No. 3,015,128 (Somerville), U.S. Pat. No. 3,310,612 (Somerville), U.S. Pat. No. 3,389,194 (Somerville) and an article in Chemical Technology, Oct. 1974, pp. 623–626 by Goodwin and Somerville entitled Microencapsulation by Physical Methods". All of the foregoing are herein incorporated by reference.

Note should be taken that the encapsulated active materials aforedescribed were intended for powdered products as coparticulates with the base detergent granules. There was no consideration given to these particles as suitable in thixotropic liquids.

It is an object of the present invention to provide a cleaning composition of great aesthetic appeal and physically distinguished from that of powders, thixotropic liquids and opaque gels.

A further object of this invention is to provide a cleaning composition that incorporates the convenient flow features of a liquid with the component separating characteristics normally associated with powdered solids.

A still further object of this invention is to provide a gel that is clear and contains active materials protected from interaction with other components of the gel.

These and other objects of the present invention will become apparent as further details are provided in the subsequent discussion and Examples.

SUMMARY OF THE INVENTION

A cleaning composition is provided comprising:

( i) a clear gel comprising from 5% to 99.95% water and from 0.05% to 95% of a surfactant; and (ii) opaque particles of an active material uniformly dispersed and suspended within said gel, said active material being surrounded by a protective substance, the ratio of said active material to protective substance ranging from about 1:100 to 100:1 and said clear gel to said opaque particles being in a ratio of from about 500:1 to 5:1.

Opaque particles may comprise one or more protective encapsulating layers surrounding the active material. Alternatively, the active material may be embedded in a matrix of the protective substance. Representative of active materials are chlorine and oxygen bleaches, bleach precursors, enzymes, fabric softeners, surfactants, perfumes and mixtures thereof.

DETAILED DESCRIPTION OF THE INVENTION

Cleaning compositions of this invention should possess a viscosity of from about 1,000 to 20,000 cps at 25° C. as measured in a Haake Rotovisco RV-100 Viscometer under a shear rate of 5 $sec^{-1}$ (storage conditions). Preferably, viscosity under the aforementioned conditions should range from about 1,500 to 10,000 cps, optimally between 3,000 and 7,000 cps. When subjected to flow, as represented by a shear rate of 21 $sec^{-1}$ at 25° C., the viscosity should range from about 200 to 5,000 cps. Preferably, the viscosity should range from about 800 to 4,000 cps, optimally from 900 to 2,500 cps.

A further rheologic property that the gel may optimally possess is that of recoil. In other words, the gel should optimally have an elastic nature rendering the material non-dripping. When tilting a container upright again after pouring, the discharging gel should exhibit a memory, recoiling back into the container without leaving any drop of liquid around the container mouth. A physical measure of recoil or elasticity is $J_e°$, the steady state compliance value. $J_e°$ is derived from steady state viscoelastic deformation measurements performed through well known standard techniques (see J. Ferry, "Viscoelastic Properties of Polymers", Third Edition, John Wiley & Sons, New York, 1980). $J_e°$ reflects the elastic deformation and/or energy stored in the elastic components of a fluid during steady flow. This value identifies the extent to which a fluid rebounds when stress is removed. Rebounding or recoil is a property associated with visual perception of elasticity. The $J_e20$ value should be greater than about 0.01 meters$^2$/Newton, preferably greater than about 0.02 meter$^2$/Newton, and optimally between 0.02 and 0.10.

One or more surfactants will be present in the compositions of the present invention. Broadly, the surfactant will have a concentration ranging from 0.05 to 95% by weight of the cleaning composition. Preferably, the surfactant amount will range from about 0.1 to about 40%, in some circumstances from about 0.15 to 25%, and depending upon the area of use, the concentration may even be as low as from about 0.2 to 5% by weight of the composition. Useful surfactants include anionic, nonionic, cationic amphoteric, zwitterionic types and mixtures of these surface active agents. Such surfactants are well known in the detergent art and are described at length in "Surface Active Agents and Detergents", Vol. II, by Schwartz, Perry & Birch, Interscience Publishers, Inc. 1958, herein incorporated by reference.

Anionic synthetic detergents can be broadly described as surface active compounds with one or more negatively charged functional groups. Soaps are included within this category. A soap is a $C_8$–$C_{22}$ alkyl fatty acid salt of an alkali metal, alkaline earth metal, ammonium alkyl substituted ammonium or alkanolammonium salt. Sodium salts of tallow and coconut fatty acids and mixtures thereof are most common. Another important class of anionic compounds are the water-soluble salts, particularly the alkali metal salts, of organic sulfur reaction products having in their molecular structure an alkyl radical containing from about 8 to 22 carbon atoms and a radical selected from the group consisting of sulfonic acid and sulfuric acid ester radicals. Organic sulfur based anionic surfactants include the salts of $C_{10}$–$C_{16}$ alkylbenzene sulfonates, $C_{10}$–$C_{22}$ alkane sulfonates, $C_{10}$–$C_{22}$ alkyl ether sulfates, $C_{10}$–$C_{22}$ alkyl sulfates, $C_4$–$C_{10}$ dialkyl sulfosuccinates, $C_{10}$–$C_{22}$ acyl isethionates, alkyl diphenyloxide sulfonates, alkyl naphthylene sulfonates, and 2-acetamido hexadecane sulfonates. Also included are nonionic alkoxylates having a sodium alkylene carboxylate moiety linked to a terminal hydroxyl group of the nonionic through an ether bond. Counterions to the salts of all the foregoing may be those of alkali metal, alkaline earth metal, ammonium, alkanolammonium and alkylammonium types.

Nonionic surfactants can be broadly defined as compounds produced by the condensation of alkylene oxide groups with an organic hydrophobic material which may be aliphatic or alkyl aromatic in nature. The length of the hydrophilic or polyoxyalkylene radical which is condensed with any particular hydrophobic group can be readily adjusted to yield a watersoluble compound having the desired degree of balance between hydrophilic and hydrophobic elements. Illustrative, but not limiting examples, of various suitable nonionic surfactants types are:

(a) polyoxyethylene or polyoxypropylene condensates of aliphatic carboxylic acids, whether linear- or branched-chain and unsaturated or saturated, containing from about 8 to about 18 carbon atoms in the aliphatic chain and incorporating from 5 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid.

(b) polyoxyethylene or polyoxypropylene condensates of aliphatic alcohols, whether linear- or branched-chain and unsaturated or saturated, containing from about 6 to about 24 carbon atoms and incorporating from about 5 to about 50 ethylene oxide and/or propylene oxide units. Suitable alcohols include "coconut" fatty alcohol, "tallow" fatty alcohol, lauryl alcohol, myristyl alcohol and oleyl alcohol. Particularly preferred nonionic surfactant compounds in this category are the "Neodol" type products, a registered trademark of the Shell Chemical Company.

Also included within this category are nonionic surfactants having the formula:

$$R-(\underset{\underset{R'}{|}}{CH_2CHO})_x(CH_2CH_2O)_y(\underset{\underset{R''}{|}}{CH_2CHO})_z-H$$

wherein R is a linear alkyl hydrocarbon having an average of 6 to 10 carbon atoms, R′ and R″ are each linear alkyl hydrocarbons of about 1 to 4 carbon atoms, x is an integer from 1 to 6, y is an integer from 4 to 15 and z is an integer from 4 to 25. A particularly preferred example of this category is Poly-Tergent SLF-18, a registered trademark of the Olin Corporation, New Haven, Conn. Poly-Tergent SLF-18 has a composition of the above formula where R is a $C_6$–$C_{10}$ linear alkyl mixture, R′ and R″ are methyl, x averages 3, y averages 12 and z averages 16.

(c) polyoxyethylene or polyoxypropylene condensates of alkyl phenols, whether linear- or branched-chain and unsaturated or saturated, containing from about 6 to about 12 carbon atoms and incorporating from about 5 to about 25 moles of ethylene oxide and/or propylene oxide.

(d) polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tristearate, sorbitan monooleate, and sorbitan trioleate. The polyoxyethylene chains may contain between 4 and 30 ethylene oxide units, preferably about 20. The sorbitan ester derivatives contain 1, 2or 3 polyoxyethylene chains dependent upon whether they are mono-, di- or tri-acid esters.

(e) polyoxyethylene-polyoxypropylene block copolymers having the formula:

$$HO(CH_2CH_2O)a(CH(CH_3)CH_2O)_b(CH_2CH_20)_cH$$

wherein a, b and c are integers reflecting the respective polyethylene oxide and polypropylene oxide blocks of said polymer. The polyoxyethylene component of the block polymer constitutes at least about 40% of the block polymer. The material preferably has a molecular weight of between about 2,000 and 10,000, more preferably from about 3,000 to about 6,000. These materials are well known in the art. They are available under the trademark "Pluronics", a product of BASF-Wyandotte Corporation.

Amphoteric synthetic detergents can be broadly described as derivatives of aliphatic and tertiary amines, in which the aliphatic radical may be straight chain or branched and wherein one of the aliphatic substituents contain from about 8 to about 18 carbons and one contains an anionic water-solubilizing group, i.e. carboxy, sulpho, sulphato, phosphato or phosphono. Examples of compounds falling within this definition are sodium 3-dodecylamino propionate and sodium 2-dodecylamino propane sulfonate.

Zwitterionic synthetic detergents can be broadly described as derivatives of aliphatic quaternary ammonium, phosphonium and sulphonium compounds in which the aliphatic radical may be straight chained or branched, and wherein one of the aliphatic substituents contains from about 8 to about 18 carbon atoms and one contains an anionic water-solubilizing group, e.g. carboxy, sulpho, sulphato, phosphato or phosphono. These compounds are frequently referred to as betaines. Besides alkyl betaines, alkyl amino and alkylamido betaines are encompassed within this invention. Cocoamido-propyl dimethyl betaine is a particularly useful surfactant.

Water is an important component. Amounts of water present in the gel compositions should neither be so high as to produce unduly low viscosity and fluidity nor so low as to produce unduly high viscosity and low flowability. Thixotropic properties in either case may be diminished or destroyed. Water will generally be present in an amount ranging from about 25 to 80%, preferably from about 45 to 75%, optimally from about 55 to 65% by weight of the composition.

Unless the surfactant is capable of inducing gellation, it will usually be necessary to incorporate a thickening agent into the composition. Normally a polymeric thickener is most efficient. Not all gelling thickeners will form clear product. Thickeners that will provide clear gels are found among certain types of cross-linked polymers.

In one embodiment of this invention, the polymeric thickener may be a polycarboxylic polymer that has been interpolymerized with a multi-vinyl or multi-allylic functionalized cross-linking agent. Preferably, the polycarboxylic polymer is interpolymerized with a polyalkenyl polyether of a polyhydric compound. The polyhydric compound should have at least 4 carbons and 3 hydroxy groups. These thickeners are described in U.S. Pat. No. 2,798,053 and U.S. Pat. No. 4,130,501, both of which are herein incorporated by reference. More specifically, the thickeners are water dispersible copolymers of an alpha-beta monoolefinically unsaturated lower aliphatic carboxylic acid cross-linked with a polyether of a polyol. The polyol may be selected from the group consisting of oligosaccharides, reduced derivatives thereof in which the carbonyl group is converted to an alcohol group, and pentaerythritol. The hydroxyl groups of the polyol are etherified with allyl groups, said polyol having at least two allyl groups per polyol molecule. A suitable copolymer is one of acrylic acid with low percentages (0.71 to 1.5%) poly allyl sucrose.

Molecular weight of the cross-linked polymeric thickener may range from about 500,000 up to 10,000,000, preferably between 500,000 and 2,000,000. Examples of commercially available crosslinked polymers based upon allyl sucrose modified polyacrylic acid are the Carbopole resins manufactured by the B.F. Goodrich Chemical Company. Most preferred is Carbopol 941 ©(m.w. 1,250,000), which gives the best transparency.

The polymeric thickener may be present in an amount from about 0.1 to about 10%, preferably from about 0.5 to 2%, optimally between about 0.7 and 1.5% by weight of the composition In conjunction with the polymeric thickener, there may be present a co-structurant such as a trivalent metal containing material. Most effective are those materials containing aluminum, especially aluminum salts or aluminum oxides. Among the inorganic aluminum salts that have been found useful are those with counterions selected from sulfate, chloride, phosphate, nitrate, chlorhydroxide, bromide, carbonate and fluoroborate. Alumina is an especially effective source of aluminum. A preferred form of this material is boehmite, a crystalline phase of aluminum oxyhydroxide. Most preferred is a semi-crystalline phase commonly known as pseudoboehmite. Trivalent metal containing material may be present in an amount from 0.01 up to 4%, preferably from about 0.1 to about 2%, optimally from about 0.1 to 1% by weight of the composition.

An alternative co-structurant to that of the alumina materials is hectorite clay. This clay may be present in an amount from about 0.005 to about 0.5% by weight.

A third co-structurant may also be desirable for use in conjunction with the polymeric thickener and trivalent metal containing material, namely a water-soluble structuring chelant. Carbonates, pyrophosphates and mixtures of these two salts are the preferred chelants. For purposes of clarity, it becomes important to select potassium as the counterion to the carbonate and/or pyrophosphate. Small amounts of sodium may, however, be tolerated. Thus, the molar ratio of potassium to sodium ions should be preferably greater than 1:1, and optimally greater than 4:1. Under situations where potassium carbonate and potassium pyrophosphate are both present, the relative ratio of these chelants will be from 1:10 to 10:1, preferably from 1:4 to 4:1, optimally about 1:4 to 1:1.5. The amount of chelant may range anywhere from about 1% up to about 60%, preferably between about 50 and 35%, optimally between about 25 and 30% by weight of the composition.

Minor amounts of various other adjuvants may be present in the gel composition with the proviso that these adjuvants not interfere with clarity. Thus, the compositions may include perfumes, flow control agents, soil suspending agents, antiredeposition agents, anti-tarnish agents, germicides and other functional additives.

The term "clear" as used in the specification is intended to connote its usual dictionary definition. Thus, a clear composition allows ready viewing of objects behind it. By contrast, a translucent composition although allowing light to pass through, causes light to be so scattered as by a very small proportion of crystals or insolubles, that it will be impossible to clearly identify objects behind the translucent material. Within the context of this invention, the composition is deemed to be clear if the maximum transmittance of light through a sample 2 cm thick is at least 10%. A gel is deemed translucent if the maximum transmittance of such light through the sample is between 1% and less than less than 10%. Finally, a gel is deemed opaque if the maximum transmittance of such light is below 1%. This transmittance can easily be measured by placing a gel sample of the aforestated thickness in the light path probe of a Brinkmann PC 800 Colorimeter fitted with a 470 nm filter. Distilled water is considered a baseline for 100% transmittance.

Besides the clear gel, the cleaning composition of the present invention includes opaque particles which are uniformly dispersed and suspended within the gel. The opaque particles are usually present from about 0.5 to about 25% by weight of the cleaning composition. Preferably, the opaque particles range in weight from about 1% to 15%, optimally from about 5% to 10%. particle size may range from about 100 microns up to about 3,000 microns average size, preferably from about 500 to about 2,000 microns, optimally between about 850 and 1,500 microns.

Opaque particles of this invention will comprise an active material and one or more protective substances. The protective substances may be one or more encapsulating layers surrounding a core of active material. Alternatively, the active material may be embedded in a matrix of the protective substance. Agglomeration processing usually gives rise to the aforementioned active embedded matrix. In either situation, the ratio of total active material to total protective substance will range from about 1,000 to 100:1, preferably from about 1:10 to 15:1, optimally about 1:1 to 6:1.

The weight ratio of transparent gel formulation to opaque particles will range from about 500:1 to 5:1, preferably from about 100:1 to 10:1, optimally about 20:1.

A wide variety of protective substances may be utilized and the substances will vary depending upon the active material protected and the eventual application of the cleaning composition. A protective substance may be defined as one that is non-reactive with the active material and prevents the active material from adversely interacting with the gel components and vice versa under storage conditions. Protective substances may include inorganic salts, hydrocarbon and vegetable waxes, organic esters, soaps, homo and copolymers, long chain fatty acids, polyalkoxylates, polyglycolates, organic amides and mixtures thereof. A characteristic of the foregoing substances is that the melting point must be between 25° C. and about 200° C., preferably between 35° C. and about 100° C. substances that may be included are the glassy phosphates. Inorganic salts may also serve as a diluent protective substance intimately mixed or agglomerated with the active material to form a matrix, the total matrix being covered by a soap, homopolymer, copolymer, wax, or other organic surface coating.

A wide variety of homopolymers an copolymers are suitable as the protective substance. Illustrative homopolymers may be polyacrylates, polymethacrylates, polyethylene, polypropylene, polyoxypropylene, polyvinyl acetate and polyvinyl alcohol.

Illustrative copolymers may be those formed from styrene, acrylic acid, methacrylic acid, vinyl acetate, crotonic acid, vinyl neodecanoate and butenoic acid. Exemplative of carboxylate type copolymers are the styrene/alkyl acrylate and partially esterified polyacrylic and polymethacrylic salts and free acid forms. Among the foregoing materials are poly(butyl methacrylate), poly(methyl acrylate), poly(methyl methacrylate), poly(acrylic acid/$C_1$-$C_{20}$ alkyl methacrylate), poly(methacrylic acid/$C_1$-$C_{20}$ alkyl acrylate), poly(acrylic acid/$C_1C_{20}$ alkyl acrylate) and poly(methacrylic acid/$C_1$-$C_{20}$ alkyl methacrylate). These copolymers may be prepared by polymerization of the respective monomers by traditional oil-in-water or water-in-oil emulsion polymerization techniques. Alternatively, a pseudo latex may be prepared by esterification of preformed polymer with $C_1$-$C_{20}$ alkanol.

It is to be understood that the terms homopolymer and copolymer are each a sub-category of "polymer". Moreover, the term copolymer includes polymers fashioned from 2 to 6 different monomers in block or random linkage.

Active materials may include chlorine and oxygen bleaches, bleach precursors, enzymes, fabric softeners, surfactants, perfumes and mixtures thereof.

When the active material is an oxidizing material, it may be a chlorine or bromine releasing agent or a peroxygen compound. Among suitable reactive chlorine or bromine oxidizing materials are heterocyclic N-bromo and N-chloro imides such as trichlorocyanuric, tribromocyanuric, dibromocyanuric and dichlorocyanuric acids, and salts thereof with water-solubilizing cations such as potassium and sodium.

Dry, particulate, water-soluble anhydrous inorganic salts are likewise suitable for use herein such as lithium, sodium or calcium hypochlorite and hypobromite. Chlorinated trisodium phosphate is another active material. Sodium dichloroisocyanurate is, however, usually the preferred bleaching agent and is available as the dihydrate from the Olin Corporation under the trademark Clearon CDB-56 or unhydrated from the Monsanto Company as ACL 60.

Organic peroxy acids may be utilized as the active material within the opaque particle. The peroxy acids usable in the present invention are solid and, preferably, substantially waterinsoluble compounds. By "substantially water-insoluble" is meant herein a water-solubility of less than about 1% by weight at ambient temperature. In general, peroxy acids containing at least about 7 carbon atoms are sufficiently insoluble in water for use herein.

Typical monoperoxy acids useful herein include alkyl peroxy acids, alkenyl peroxy acids and aryl peroxy acids such as:

(i) peroxybenzoic acid and ring-substituted peroxybenzoic acids, e.g. peroxy-a-naphthoic acid
(ii) aliphatic and substituted aliphatic monoperoxy acids, e.g. peroxylauric acid and peroxystearic acid.

Typical diperoxy acids useful herein include alkyl diperoxy acids, alkenyl diperoxy acids and aryldiperoxy acids, such as:

(iii) 1,12-diperoxydodecanedioic acid
(iv) 1,9-diperoxyazelaic acid
(v) diperoxybrassylic acid; diperoxysebacic acid and diperoxyisophthalic acid
(vi) 2-decyldiperoxybutane-1,4-dioic acid.

Inorganic peroxygen generating compounds may also be suitable as particles for coating in the present invention. Examples of these materials are salts of monopersulfate, perborate monohydrate, perborate tetrahydrate, and percarbonate.

Solid bleach precursors or activators may also be usefully coated by the process of the present invention. Illustrative of organic precursors are N,N,N',N'-tetraacetylethylene diamine (TAED), benzoyloxybenzene sulfonate and sodium nonanoyloxybenzene sulfonate. Inorganic bleach catalysts such as manganese salts or manganese ions adsorbed onto aluminosilicate supporting substrates such as zeolites could also benefit from this invention. The manganese catalysts may be prepared according to the method primarily described in U.S. Pat. No. 4,536,183 (Namnath). Other catalysts of this type are more fully described in U.S. Pat. No. 4,601,845 (Namnath), U.S. Pat. No. 4,626,373 (Finch et al.) and co-pending U.S. application Ser. No. 837,613 (Rerek).

An especially preferred catalyst for promoting peroxygen bleaching is the complex of manganese (III) and a multidentate ligand supplied by a complexing agent, preferably a hydroxycarboxylic acid containing at least 5 carbon atoms and the salts, lactones, acid esters, ethers and boric esters thereof. Illustrative of such complexes is manganese (III) gluconate.

Enzymes and perfumes may be used as the active materials. These enzymes and perfumes may be deposited or entrapped upon a supporting substrate such as an inorganic salt, aluminosilicate, organic polymer or other non-interactive solid base material. Suitable enzymes include those classed under lipase, protease, cellulase and amylase. Particularly preferred is the protease known as Savinase® and the amylase known as Termanyl®.

In addition to the surfactants of the transparent gel, there may also be present surfactants as the active material. Protection of one surfactant from another is desirable when these components have different charges. For instance, anionic surfactants are preferentially separated from cationic ones. Examples of surfactants have previously been set forth in this specification, vide supra.

Fabric softeners may be used as the active material. These materials may be defined as cationic compounds having at least one long chain alkyl group of about 10 to 24 carbon atoms. See "Cationic Surfactants", Jungermann, 1970, herein incorporated by reference. Particularly preferred are non-cyclic quaternary ammonium salts such as dimethyl di-hydrogenated tallow ammonium chloride. Also suitable are $C_8$–$C_{25}$ alkyl imidazolinium salts such as those exemplified by Varisoft 475® sold by the Sherex Chemical Company.

The following examples will more fully illustrate the embodiments of the invention. All parts, percentages and proportions referred to herein and in the appended claims are by weight unless otherwise indicated.

EXAMPLE 1

Illustrated in this example is a cleaning composition used for automatic dishwashing. The base formulation outlined below is a clear gel having sufficient viscosity to be retained in an automatic dishwasher cup, but upon application of shear forces being readily pourable.

| Base Formulation | |
|---|---|
| Component | Weight % |
| Tetrapotassium pyrophosphate | 19.0 |
| Britesil H2O® (sodium silicate) | 7.5 |
| Potassium carbonate | 6.0 |
| Sodium tripolyphosphate | 1.0 |
| Potassium hydroxide | 1.0 |
| Carbopol 941 ® | 1.0 |
| Catapal D Alumina® | 0.1 |
| Water | to 100 |
| Viscosity at 5 $sec^{-1}$ shear | cps 6193 |

Efficient cleaning of dishes and glassware requires the further presence of a chlorine bleach within the base gel formulation. Control formulation A was prepared by mixing an amount of sodium hypochlorite sufficient to provide 1% available chlorine to the base formulation. A room temperature, the product began to degrade after about two weeks. A decreased viscosity and stringiness resulted and the formula no longer was able to remain in a dishwasher dispenser cup. When storage stability was evaluated at 40° C., degradation was even faster and more pronounced.

Degradation is believed to arise from attack of the Carbopol 941® by the bleach. The incompatibility problem was resolved by encapsulating the bleach. Anhydrous sodium dichloroisocyanurate was coated with a polyethylene/wax protective composition to obtain spherical particles of uniform size and appearance. These capsules had the following composition:

Encapsulated Chlorine Bleach

Active Material Mixture (Fill) 72.7%
  Anhydrous sodium dichloroisocyanurate (ACL 60®)
Protective Substance (Shell) 27.3%
  Polyethylene/Paraffin Wax Combination
Percent Available Chlorine (initial) = 16.9%
  Particle Size: 595 to 1000 microns Encapsulates were prepared with the aid of an extrusion device as described in *Chemical Technology*, Oct. 1974, article by Goodwin and Somerville entitled "Macroencapsulation by Physical Methods". The extrusion device has a head with two nozzles and a concentric feed tube which enters the head through a seal arrangement. A rotating shaft is attached to the device so that the direction of rotation is around the vertical axis of the device. Shell and fill material are pumped separately through the feed tube into the head and to the nozzles which consist of concentric orifices. As the heat rotates, shell material flows through the outer orifice of the nozzle and fill material flows through the inner orifice of the nozzle. Thereby a rod of fill material is created which is surrounded by a sheath of shell material. This extruded rod of material eventually breaks into individual capsules which are then collected.

Encapsulated bleach particles in an amount approximately 7% by weight of the total composition, and sufficient to provide 1% available chlorine, were mixed with the base formulation to obtain a finished product. Calculation of percent available chlorine remaining in the finished product was determined by a standard Iodometric titration method. There was, however, one slight modification of the method involving use of a Waring blender to ensure complete release of chlorine from the capsules. Samples of the gel were stored at room temperature and analyzed for percent remaining available chlorine on a weekly basis. Table I compares these results with respect to an identical formula but containing unencapsulated sodium hypochlorite.

TABLE I

| Capsule Stability versus Unencapsulated Hypochlorite in Detergent Gel | | |
|---|---|---|
| | % Available Chlorine | |
| Time (weeks) | Gel with Capsules | Gel With Unencapsulated Hypochlorite |
| 0 | 1.18 | 1.20 |
| 1 | 1.20 | 0.08 |
| 2 | 1.15 | 0.02 |
| 3 | 1.10 | 0.0 |
| 4 | 1.05 | 0.0 |
| 5 | 0.97 | 0.0 |
| 6 | 0.97 | 0.0 |
| 7 | 0.85 | 0.0 |

Results in Table I indicate a significant improvement in chlorine stability over a system formulated with sodium hypochlorite. Visual examination of the samples stored at both room temperature and 40° C. showed that the encapsulate containing gel retained original rheology throughout the eight weeks of testing. Most importantly, there was no significant degradation of gel rheological properties during the test period. Gel clarity was also maintained.

EXAMPLE 2

Illustrated within this Example is an alternate method of preparing encapsulated bleach particles. Sodium dichloroisocyanurate dihydrate (Clearon CDB-56 ®) at a weight of 80 grams is charged to a lab scale fluid bed coating apparatus. The fluidized bed is warmed to 60° C. A solution of styrene/maleic anhydride copolymer, half butyl ester, available commercially as SMA 1440 ® from Arco Chemical Company, is dispersed in an acetone-water solvent at about 10% concentration. The polymer solution is then atomized onto the fluidized CDB-56 particles for about two hours at a pump rate of about 2.5 ml/per minute. After all the polymer solution is exhausted, the capsules are then further fluidized for 15–30 minutes to remove residual solvent. Subsequent thereto, about 5 grams of paraffin wax dissolved in a volatile hydrocarbon solvent is added to the fluid bed to form an outer second coating.

The resultant capsules are then dispersed under low shear in the base formulation of Example 1 to provide an automatic dishwashing composition.

EXAMPLE 3

The following illustrates an active material other than chlorine bleach and a still further type of encapsulation technology that may be employed within the context of the present invention.

An oxygen-releasing bleach, diperoxydodecanedioic acid (DPDA) in an amount of 800 grams is charged into a fluidized bed (Aeromatic or Glatt equipment). A water latex of a copolymer based on poly(methacrylic acid) at approximately 50% solids is atomized into the fluid bed at a controlled rate. The temperature of the fluid bed must be held within 10° C. lowered to 20° C. higher than the glass transition temperature of the copolymer. As the water evaporates, a coating of copolymer surrounds the DPDA. Encapsulated bleach particles are then retrieved from the fluid bed apparatus.

A gel may then be prepared by mixing under low shear the base formulation of Example 1 with the opaque encapsulated particles prepared according to the above method.

The foregoing description and examples illustrate selected embodiments of the present invention. In light thereof, various modifications will be suggested to one skilled in the art, all of which are within the spirit and purview of this invention.

What is claimed is:

1. A cleaning composition comprising:

(i) a clear gel having a viscosity on a Haake Rotovisco RV-100 Viscometer at 25° under 5 $sec^{-1}$ shear of from about 1,000 to 20,000 cps and under 21 $sec^{-1}$ shear of from about 200 to 5,000 cps, a pH range from 11 to 13, a steady state viscoelastic deformation compliance $J_e°$ value greater than 0.01, and a light transmittance now lower than 10% through a sample 2 cm thick, said gel comprising:

(a) from 5% to 80% water;

(b) from 0.05% to 25% of a surfactant;

(c) from 0.1 to 10% of a thickener that is a cross-linked polycarboxylic polymer; and (d) from about 0.01 to 2% of alumina;

(ii) opaque particles of an active material selected from the group consisting of chlorine and oxygen bleaches and bleach precursors, uniformly dispersed and suspended within said gel, said active material being surrounded by a protective substance, the ratio of said active material to protective substance ranging from about 1:100 to 100:1 and said clear gel to said opaque particles being in a ratio of from about 500;1 to 5:1.

2. A composition according to claim 1 wherein the cross-linked polycarboxylic polymer has a molecular weight of at least about 500,000.

3. A composition according to claim 1 further comprising from 1 to 60% of a structuring chelant selected from the group consisting of potassium carbonate, potassium pyrophosphate, and mixtures thereof.

4. A composition according to claim 1 wherein the aluminum oxide is a semi-crystalline phase boehmite known as pseudo boehmite.

* * * * *

UNITED STATES PATENT AND TRADEMARK OFFICE

CERTIFICATE OF CORRECTION

PATENT NO. : 5,141,664
DATED : August 25, 1992
INVENTOR(S) : Corring, et. al.

It is certified that error appears in the above-indentified patent and that said Letters Patent is hereby corrected as shown below:

Title page, item [21], application No. "239,492" should read --139,492--;
Column 12, line 27, "now" should read -- not --.

Signed and Sealed this

Fourteenth Day of February, 1995

*Attest:*

*Attesting Officer*

BRUCE LEHMAN

*Commissioner of Patents and Trademarks*